US010144489B2

(12) United States Patent
Harrod

(10) Patent No.: US 10,144,489 B2
(45) Date of Patent: Dec. 4, 2018

(54) BOAT ANCHOR SYSTEM

(71) Applicant: Bruce Harrod, Gaines, MI (US)

(72) Inventor: Bruce Harrod, Gaines, MI (US)

( * ) Notice: Subject to any disclaimer, the term of this patent is extended or adjusted under 35 U.S.C. 154(b) by 0 days.

(21) Appl. No.: 15/476,960

(22) Filed: Mar. 31, 2017

(65) Prior Publication Data

US 2017/0283009 A1 Oct. 5, 2017

Related U.S. Application Data

(60) Provisional application No. 62/315,965, filed on Mar. 31, 2016.

(51) Int. Cl.

| | |
|---|---|
| ***B63B 21/26*** | (2006.01) |
| ***B63B 21/24*** | (2006.01) |
| ***B63B 21/50*** | (2006.01) |
| *B63B 21/00* | (2006.01) |

(52) U.S. Cl.

CPC ..... *B63B 21/26* (2013.01); *B63B 21/502* (2013.01); *B63B 2021/005* (2013.01)

(58) Field of Classification Search

CPC ..... B63B 21/50; B63B 21/26; E02D 5/74; E02D 5/801; E02D 5/54

USPC ..... 114/295

See application file for complete search history.

(56) References Cited

U.S. PATENT DOCUMENTS

| | | | | | |
|---|---|---|---|---|---|
| 1,883,477 | A * | 10/1932 | Bash | E02D 5/801 | 248/49 |
| 2,680,859 | A | 6/1954 | Hultberg | | |
| 2,999,572 | A * | 9/1961 | Hinckley | E02D 5/801 | 114/295 |
| 3,158,127 | A | 11/1964 | Gallaugher | | |
| 4,785,758 | A | 11/1988 | Eichelberger, Sr. | | |
| 4,793,276 | A | 12/1988 | Stafford | | |
| 5,122,014 | A * | 6/1992 | Genfan | E02D 5/801 | 248/156 |
| 5,720,235 | A | 2/1998 | Bartkus | | |
| 5,852,985 | A | 12/1998 | Fisher | | |
| 9,616,974 | B2 * | 4/2017 | Martindale | B63B 21/26 | |
| 2015/0101524 | A1 | 4/2015 | Pence | | |

FOREIGN PATENT DOCUMENTS

| | | | | |
|---|---|---|---|---|
| DE | 102006055640 A1 * | 7/2008 | E02D 5/801 | |
| DE | 102008011869 A1 * | 9/2009 | E02D 5/801 | |
| WO | WO-2010091702 A1 * | 8/2010 | E02D 5/801 | |

* cited by examiner

*Primary Examiner* — Anthony D Wiest

(74) *Attorney, Agent, or Firm* — Stephen T. Olson; Harness, Dickey & Pierce, P.L.C.

(57) ABSTRACT

A watercraft anchor having a cylindrical member having a top defining a locking surface, a bottom circular surface, and a periphery surface disposed between the top and bottom surfaces. A plurality of paddles extend from the periphery surface and align with a plurality of fins disposed on the bottom surface.

20 Claims, 12 Drawing Sheets

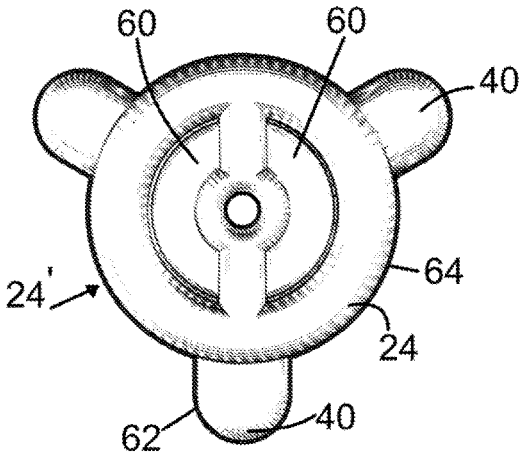
Figure 12a
Figure 12b
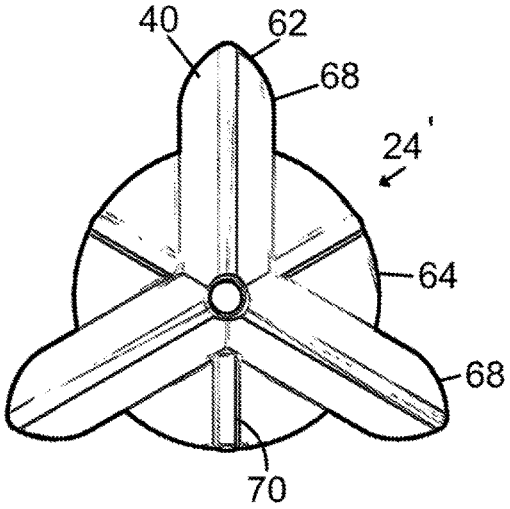
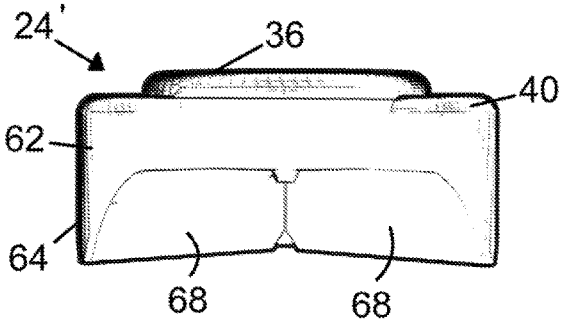
Figure 12c
Figure 12d
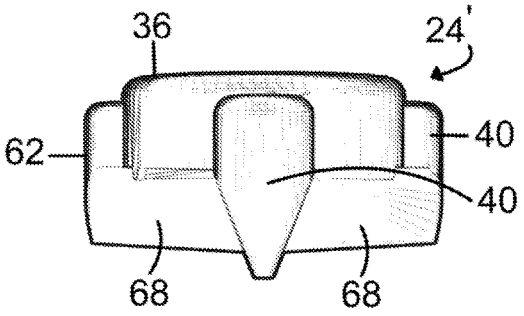

BOAT ANCHOR SYSTEM

CROSS-REFERENCE TO RELATED APPLICATIONS

This application claims the priority of U.S. Provisional Application No. 62/315,965 filed on Mar. 31, 2016. The entire disclosure of the above application is incorporated herein by reference.

FIELD

The present disclosure relates to an anchor for a mobile platform and specifically to an anchor for a boat.

BACKGROUND

This section provides background information related to the present disclosure which is not necessarily prior art.

Recreational boating is often conducted in shallow water. Boaters in these waters desire to precisely locate and anchor their boat in these areas. Conventional anchors are typically placed on the ground surface below the water. As is known, these anchors have flutes which dig into the soil or sand.

This section provides a general summary of the disclosure, and is not a comprehensive disclosure of its full scope or all of its features.

Disclosed is a watercraft anchor system having a cylindrical member having a top defining a locking surface, a bottom circular surface, and a periphery surface disposed between the top and bottom surfaces. A plurality of paddles extends from the periphery surface. A plurality of fins disposed on the bottom surface.

According to another teaching, a method of anchoring a boat into sand under water is disclosed. The method includes coupling an anchor locking surface to an insertion tool, and positioning the anchor onto a sand surface. A rotary and axial force is applied onto the anchor through the insertion tool to press the anchor into the sand a predetermined depth. The insertion tool is extracted from the sand while leaving the anchor under the sand.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 9A:
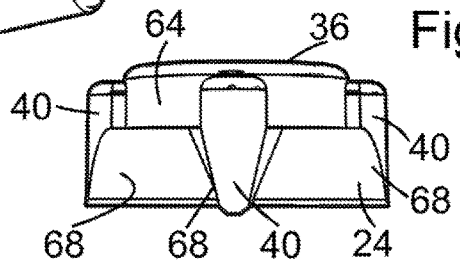
Figure 9B:
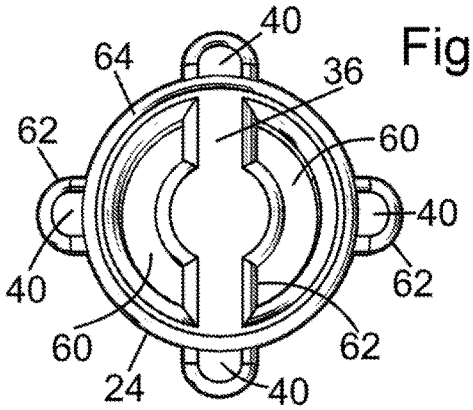
Figure 9C:
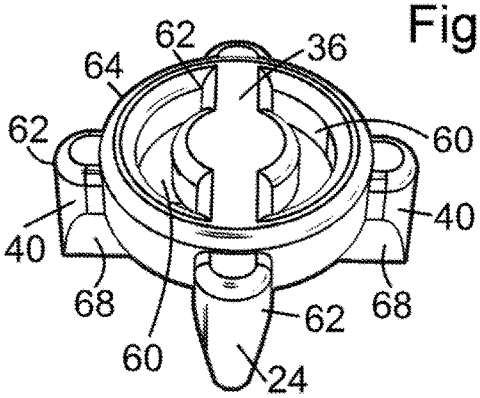
Figure 10:
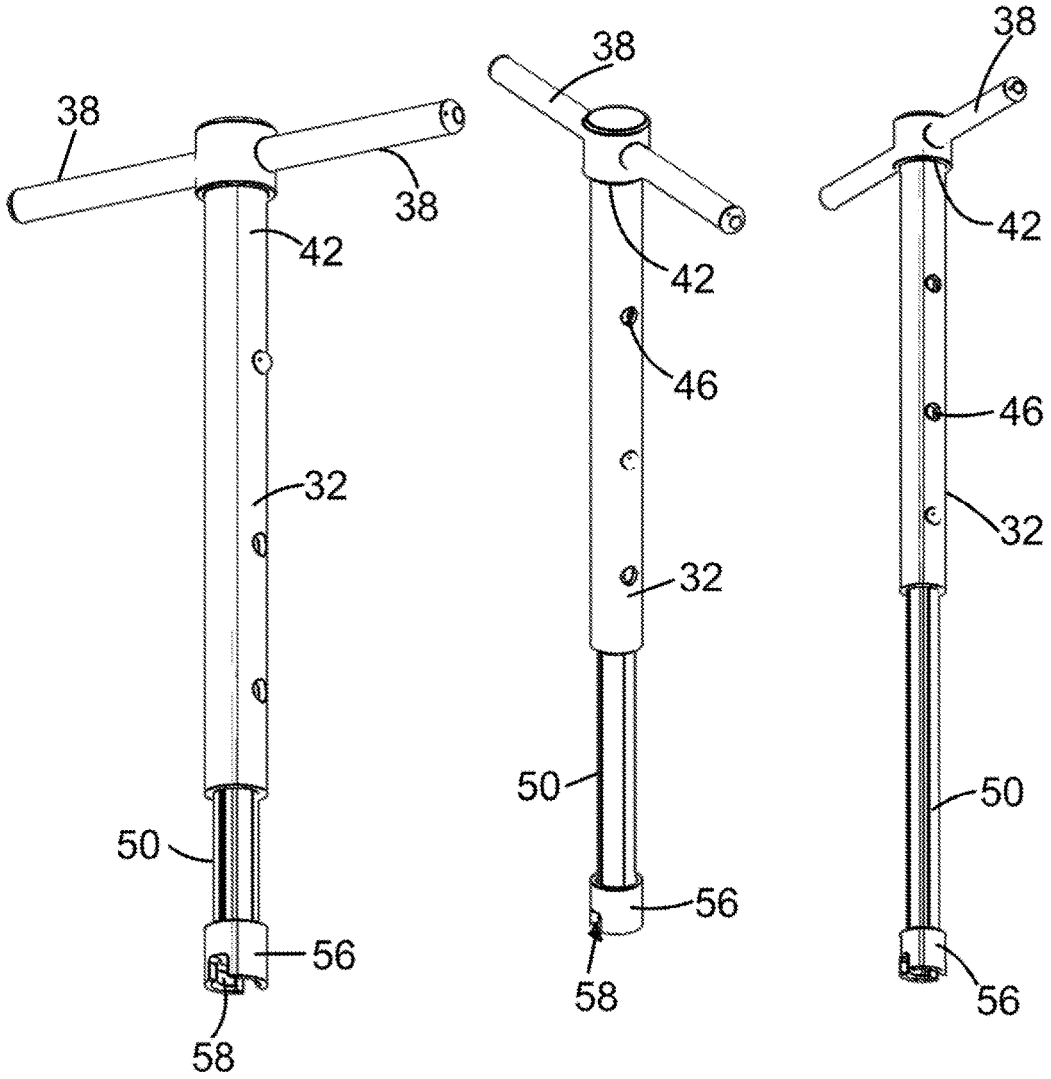
Figure 11A:
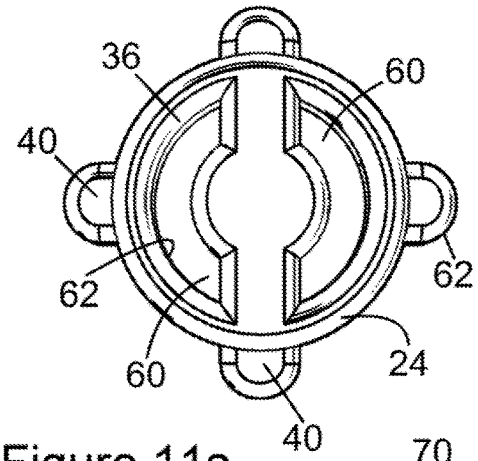
Figure 11B:
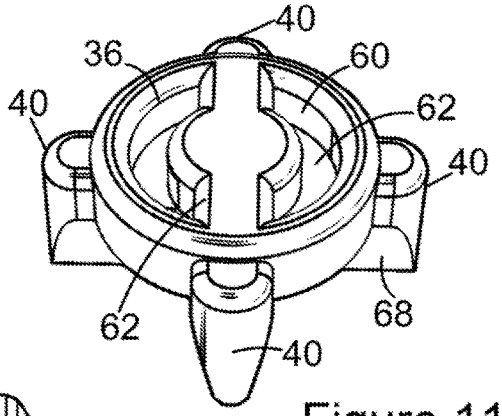
Figure 11C:
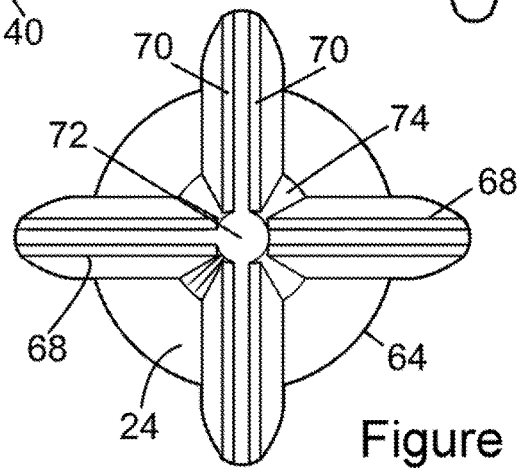
Figure 11D:
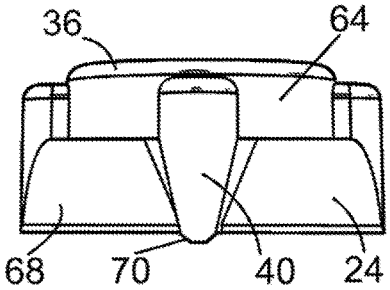
Figure 11E:
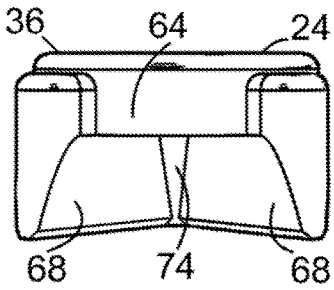
Figure 13:
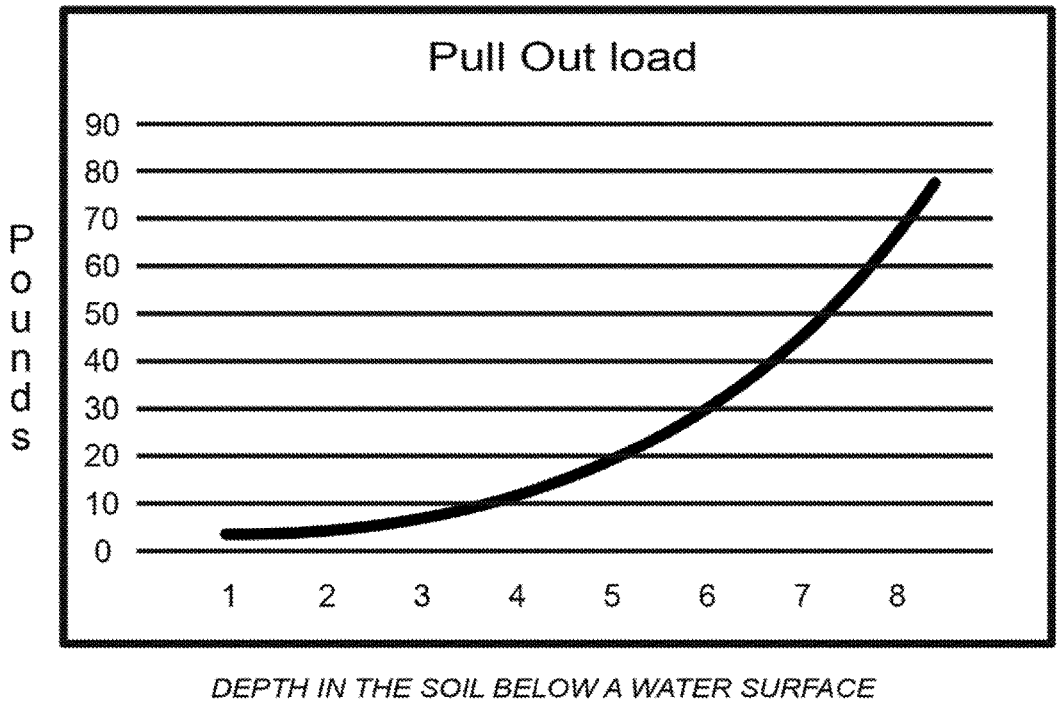

FIGS. 9*a*-9*c* represents anchors according to the present teachings;

FIG. 10 represents three insertion tools;

FIGS. 11*a*-11*e* represent various views of the anchor shown in FIGS. 1-7;

FIGS. 12*a*-12*d* represent an alternate anchor according to the present teachings; and FIG. 13 represents load vs insertion depth.

Corresponding reference numerals indicate corresponding parts throughout the several views of the drawings.

DETAILED DESCRIPTION

Example embodiments will now be described more fully with reference to the accompanying drawings.

Figure 1:
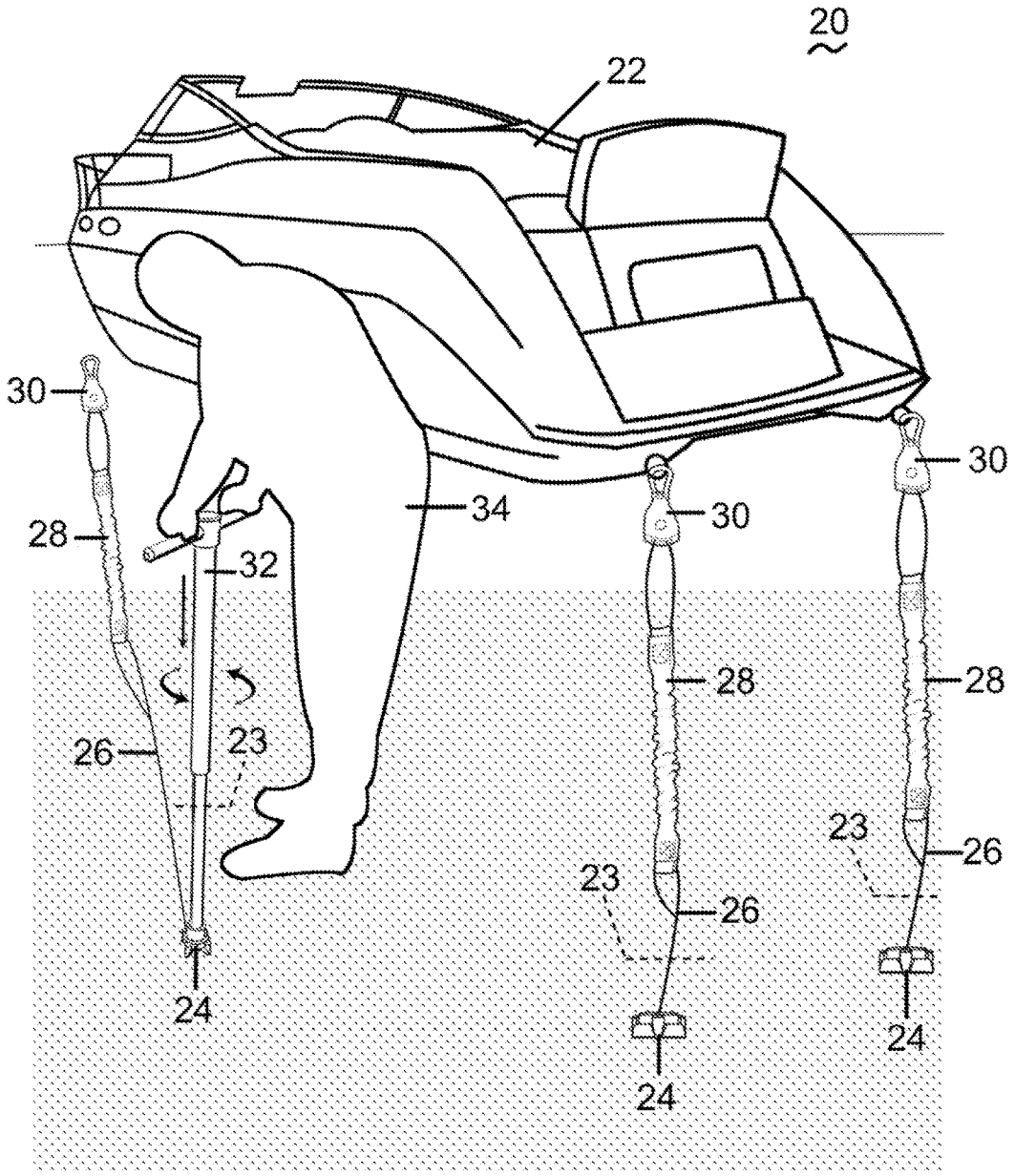
FIG. 1 represents a boat anchoring system according to the present teachings.
Figure 2:
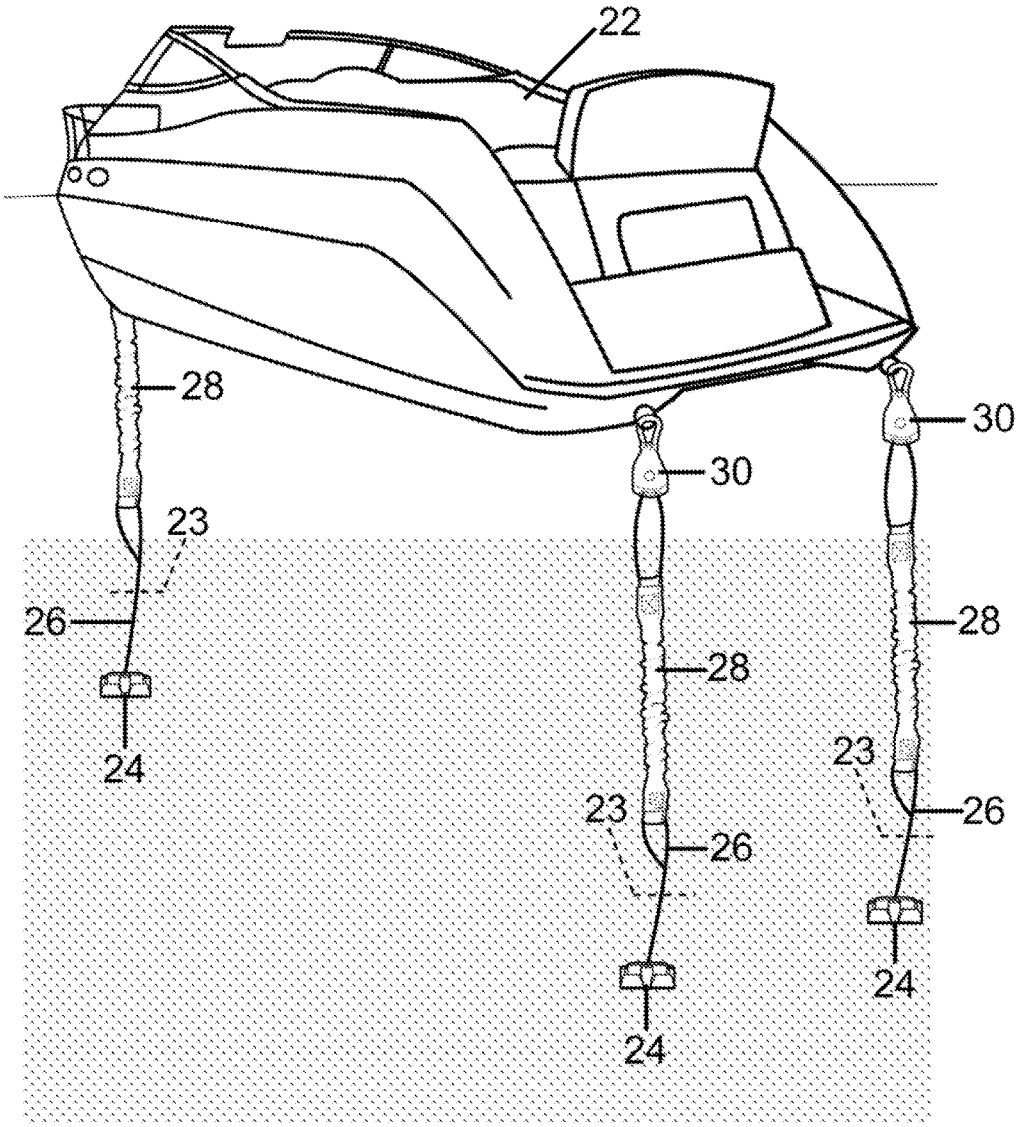
FIG. 2 represents an anchored boat according to the present teachings.

FIGS. 1 and 2 represent a boat anchoring system 20 according to the present teachings. The boat anchoring system 20 is configured to restrict the movement of a boat 22 with respect to a ground surface 23 under water. The boat anchoring system 20 includes an anchor 24, which as will be described below is inserted in the ground or sand beneath the ground surface 23. Attached to the anchor 24 is a first coupling cord 26, which is coupled to an elastic member 28. At an opposite end of the elastic member is a boat coupling 30 which are fixed to fixed locations on the boat 22. A user 34 uses an extendable insertion tool 32 is agitated and rotated to drive the anchor 24 into the ground or sand. The boat couplings 30 can be coupled to a bow and stern of the boat in a manner which placed the anchors generally below the boat so that the first coupling cord emerges from the ground surface 23 generally perpendicular to the ground surface.

Figure 3:
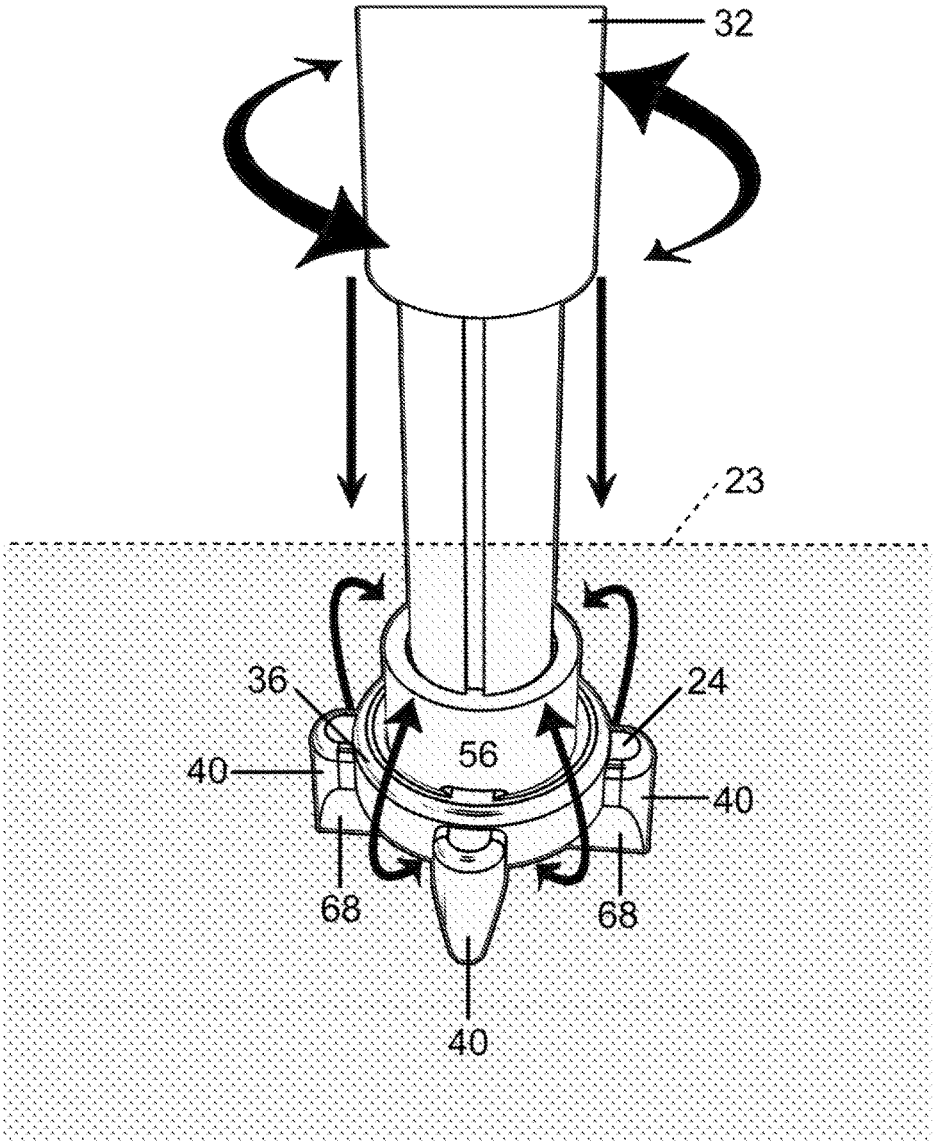
FIG. 3 represents the insertion of the anchor shown in FIG. 1.

FIG. 3 represents the insertion of the anchor 24 shown in FIG. 1. As described below, the insertion tool 32 is coupled to a top surface of the anchor 24. During the insertion of the anchor 24, the user 34 pressed onto a pair of handles 38 while agitating in a rotating manner the insertion tool 32 thus pushing the anchor 24 into the ground surface 23. The anchor 24 has a plurality of exterior paddle projections 40 which facilitate the movement of sand from below the anchor 24 to above the anchor 24.

Figure 4:
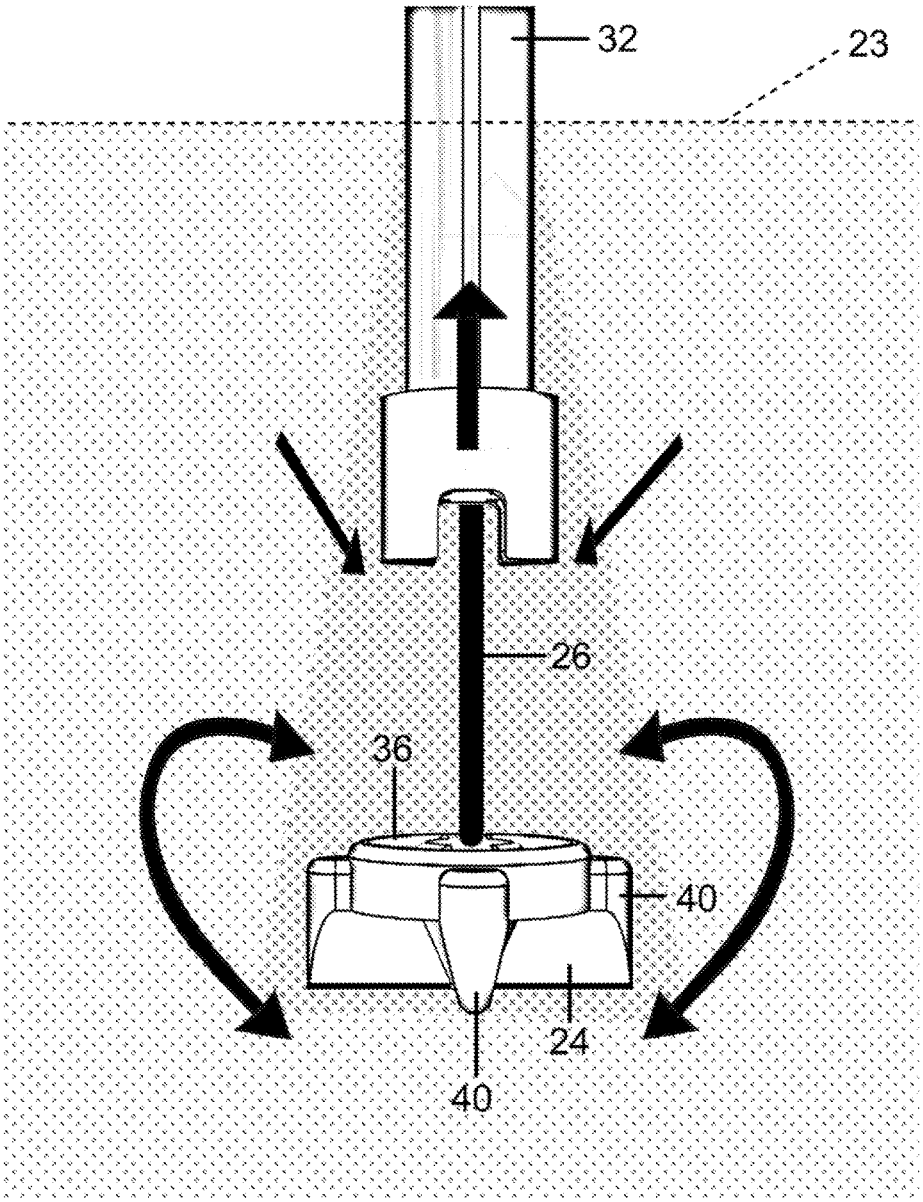
FIG. 4 represents the removal of the insertion tool.

FIG. 4 represents the removal of the insertion tool 32 leaving the anchor 24 below the ground surface 23. During the extraction of the insertion tool 32, sand from locations adjacent to the tool, collapses into the space left by the removed tool. During application of a suction disc, numerous processes are taking place simultaneously to assist an efficient and effective anchor set. During the setting procedure, downward force is applied to the applicator handle while agitating the handle. This agitation and downward force causes the cutting face of the slurry fins on the bottom of the device to scrape the topmost later of sand in the boring area, liberating it from its' hard pack condition.

At the same time, the agitation causes the side faces of the slurry fins to generate an agitated water movement. Once free from the hard pack, the sand grains are then "picked up" and suspended by the water being agitated by the slurry fins creating a slurry material. At the same time, the downward force of the disc during this procedure cause a positive pressure to build in the slurry chambers below the disc. This positive pressure forces the slurry to evacuate from the area below the disc, through the slurry gaps, and make its' way to the top side of the disc. Once the material is on the top side of the disc, the water motion decreases causing the sand to settle again, allowing the water to return to the bottom side of the disc to repeat the process.

The sand on the top side of the disc will settle as the application process occurs creating a "seal" which traps the water in the lower slurry chamber area. When the proper depth of set is reached (as indicated on the depth gauge), the applicator is removed and the water from the slurry chamber is able to escape through the hole that the applicator stem leaves when removed. The applicator is hollow and vented for at least two reasons. First, to prevent the applicator stem from creating suction when removed after installation (This causes removal to be more difficult and may dislodge the disc). Secondly, removal of our vented applicator design releases air bubbles during removal which helps to extend the time that the applicator stem hole has to settle properly without trapping water below the sand.

Figure 5:
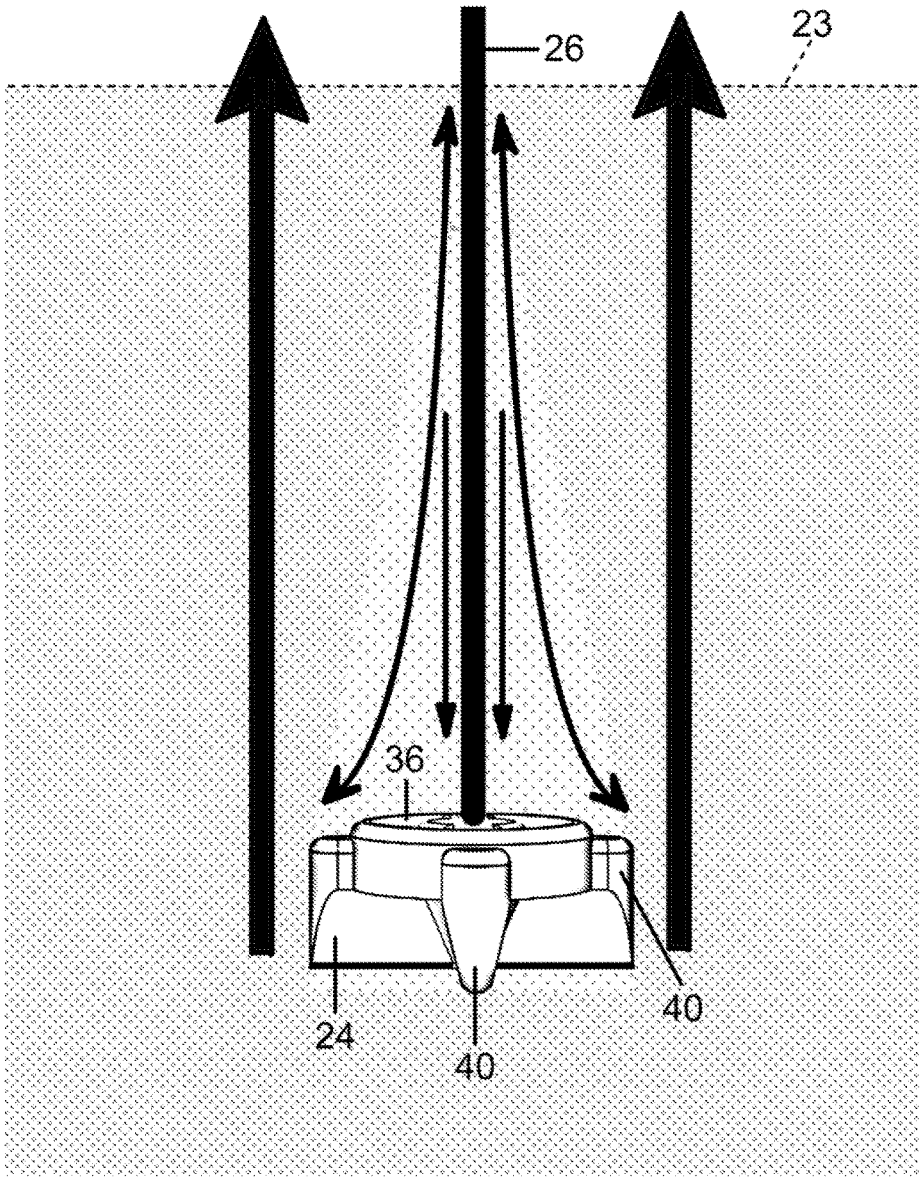
FIG. 5 represent the forces on the set anchor.
Figure 6:
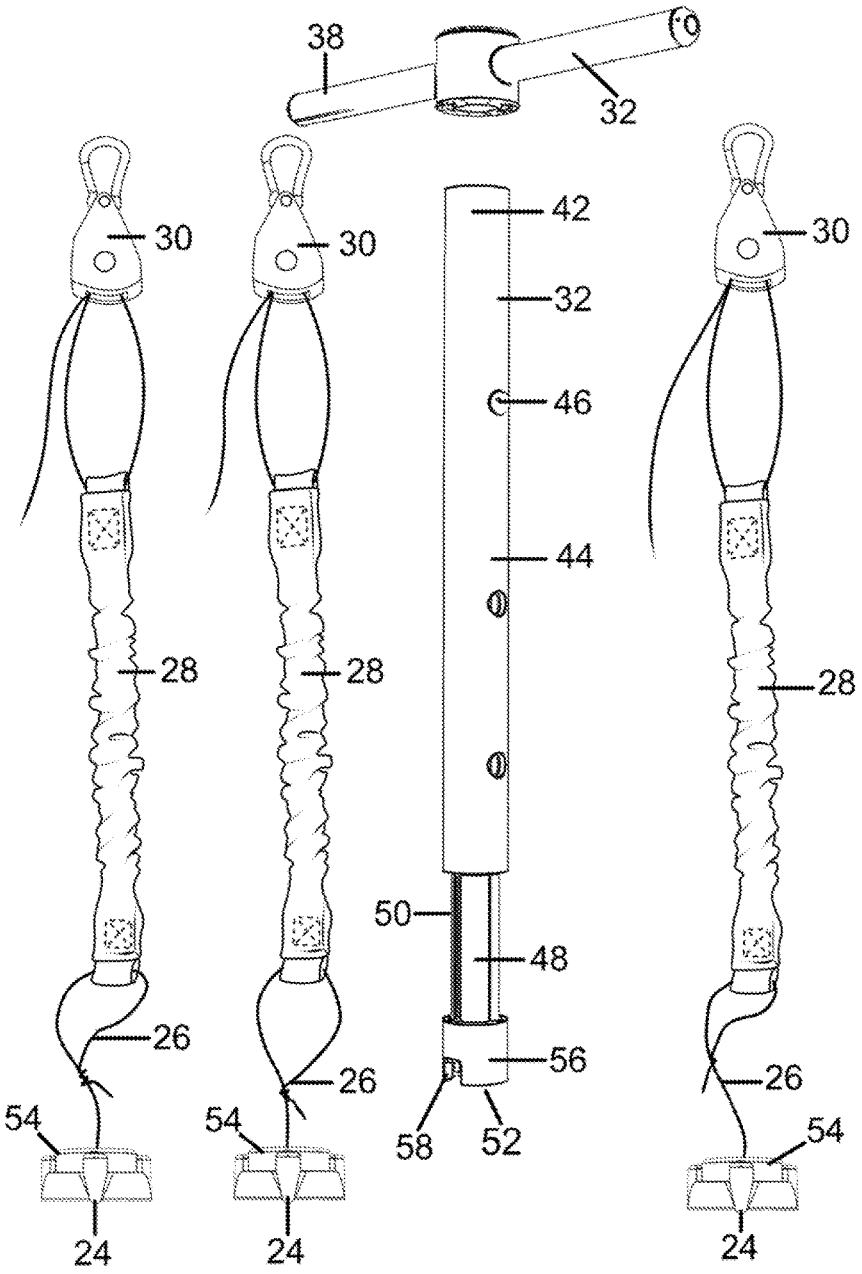
FIG. 6 represent a kit of components associated with present teachings.
Figure 7D:
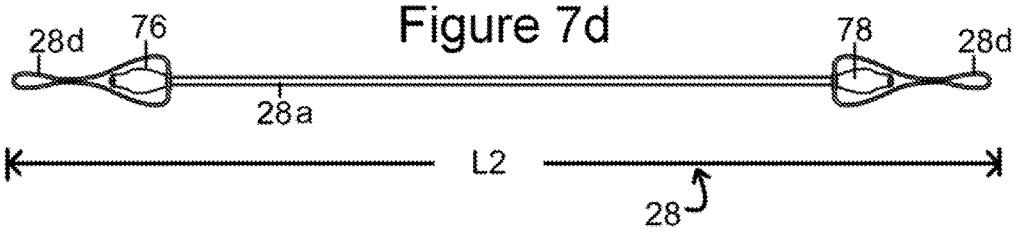
FIG. 7 represents the elastic members according to the present teachings.
Figure 7B:
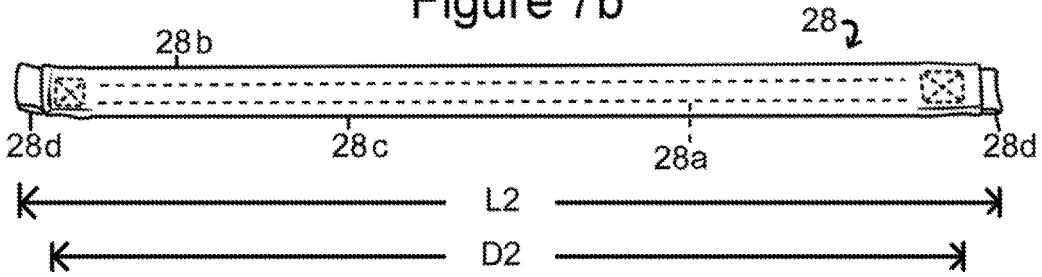
Figure 7C:
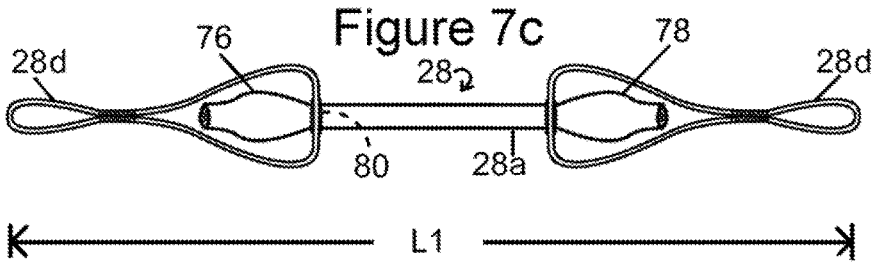
Figure 7A:
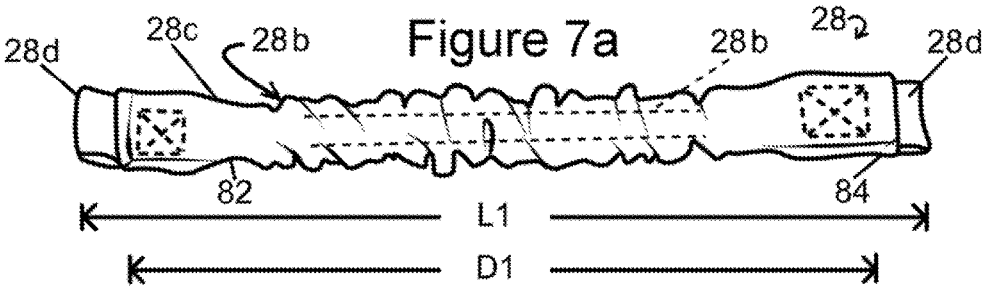
Figure 8:
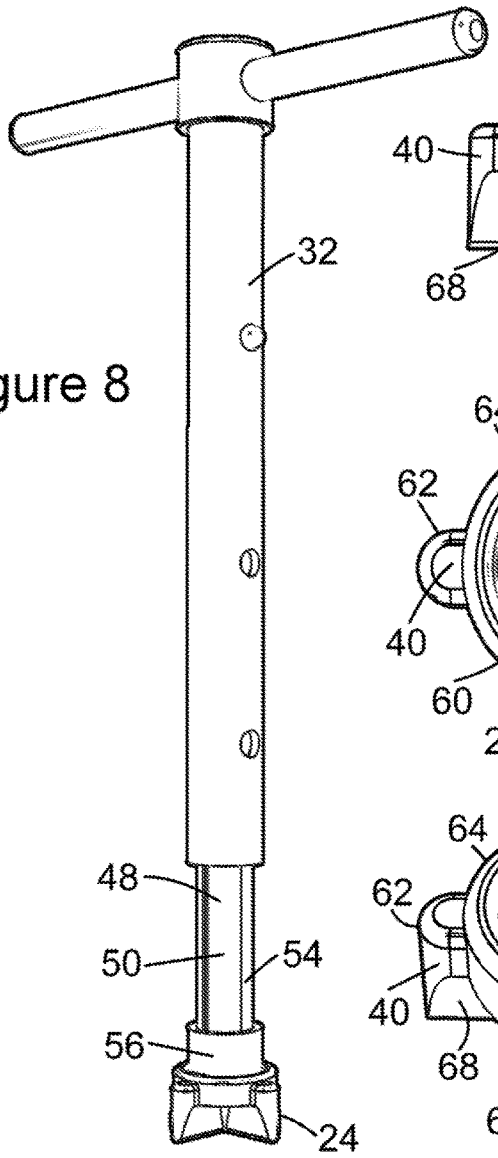
FIG. 8 represents the coupling of a tool to the anchor.

FIG. 5 represent the forces on the set anchor 24. When a load is applied to the first coupling cord 26, the top surface 36 of the anchor 24 functions to load onto the wet sand and ground immediately above the top surface of the anchor 24. Interaction of independent sand particles restrict movement of the anchor with respect to the ground surface. As will be shown in FIG. 13, the load needed to displace the anchor 24 above the ground surface 23 is a function of the depth the anchor 24 is positioned below the ground surface 23.

As shown in FIGS. 6-8 and 10 represent a kit of components associated with present teachings. The insertion tool 32 has a first end 42 which is configured to couple a shaft with the handle 38. The insertion tool 42 has a first exterior tube 44 which has a plurality of coupling features 46. Disposed within the exterior tube 44 is an interior tube 48 which is slidably disposed within the exterior tube 44. Disposed between the interior tube 48 and the interior tube is a locking surface 50 which prevents relative rotation of the interior tube 48 and the exterior tube 44. The coupling features 46 function to lock the axial movement of the exterior tube 44 with respect to the interior tube 48.

Disposed at a second end of the insertion tool 32 is an anchor coupling feature 52 which functions to couple to a locking feature 54 on the top surface 36 of the anchor 24. The coupling feature 52 has an exterior surface 56 and an interior surface 58 which couples to lock feature 54 defined in the top surface 36 of the anchor 24. The elastic members 28 can be disposed within a fabric tube 59 which limits the extension of the elastic members 28. The spring constant of the elastic member 28 can be set on expected wave size as well as the mass of the boat 22.

FIGS. 9*a*-9*c*and 11*a*-11*e*represents anchors 24 according to the present teachings. The anchor 24 top surface 36 can have a pair of arcuate cavities 60 which have interior surfaces 61 which interface with the surfaces 56 and 52 of the coupling feature 52 of the insertion tool 32. The exterior paddles 40 has an exterior curved surface 62 which interacts with sand under the ground surface 23. The paddles 40 extend past the radial exterior surface 64 of the anchor 24. Projecting from an underside of the anchor 24 is a crossed pair of tapered flanges 68 which function to displace sand and allow it to flow up adjacent to the paddles. 40 to a location above the anchor.

The various views of the anchor 24 show. Projecting from the underside of the anchor 24 is the crossed pair of tapered flanges 68 which function to displace sand and allow it to flow up adjacent to the paddles 40 to a location above the anchor 24. The tapered flanges 68 can have extended flat surfaces 70 which intersect on a flat circular surface 72 which is disposed adjacent to a conical portion 74.

FIGS. 12*a*-12*d*represent an alternate anchor 24' according to the present teachings can have three tapered flanges 68 which function to displace sand and allow it to flow up adjacent to the paddles 40 to a location above the anchor. The paddles 40 extend past the radial exterior surface 64 of the anchor 24.

FIG. 13 represents load vs insertion depth. As can be seen, the pull out load for the anchor 24 depending on depth the anchor 24 is positioned is below the surface. As can be seen, the increase in load is exponential with respect to the depth the anchor is positioned below the surface of the earth.

The anchor 24 has features which are helpful for proper function. The overall perimeter profile/shape characteristics of the disc. The top profile design as "circular with paddles". The base circular design is used because it is the most efficient shape for application (insertion) processes. Also, the optional uniform distance from center (radius) of the circle. The nodes or paddles on the exterior of the base circle are there for multiple purposes. (1) they reduce the contact area (friction) with the outside of the bore during application and (2) the offset from the base circle that they provide creates the slurry gap for slurry to escape through.

The slurry gaps created between the paddles are required to allow slurry material and water to pass through them during insertion and removal. The material displaced during insertion will have passed through these gaps during the process of insertion and the same volume of material will pass in the opposite direction during removal. The length and width of the slurry gap is designed to be adequate to pass the amount of material required in the intended time period without creating a back pressure. The slurry gap could be larger than needed without suffering adverse effects, but being too small would hinder insertion and removal.

On the lower face of the anchor the slurry fins on the bottom of the disc have multiple functions. The cutting faces of the fins are intended to scrape at the surface of the packed sand and liberate the individual grains from their packed state. The sides of the fins then work to agitate the available water and loose sand to generate a slurry material. The downward force applied to the applicator then utilizes the disc as a plunger and displaces the slurry material to the top side of the disc. By agitating instead of rotating the applicator, we do not create a definitive direction for materials to move which allows the water sent to the top side of the disc to return to the bottom side (via the slurry gaps) to repeat the slurry process instead of simple being pumped to the top side. This leaves the top side naturally settled and free of water. After the anchor gets below the surface of the ground or sand, the sand on the top side immediately begins to settle and seal around the applicator stem.

With the advent of boating season, many boats congregate out in water side by side. A typical way to stabilize the boat within the water is to drop an anchor. Many anchors are unwieldy and also present an obstacle in the water to waders around the boat. Furthermore, if the current is great enough, sometimes the boat will still tend to drift out of position over time, thereby increasing the likelihood of collision with another anchored boat nearby.

To improve on stabilizing the boat position, a system for anchoring the boat beneath the sand is provided. A retention disc contains an upper side and a lower side. The retention disc may be formed as an annular disc, wherein an opening may be created in the middle of the disc. Alternatively, an opening may be formed along the periphery of the disc for threading and securing a lead line therethrough. A lead line containing a first end and a second end may be secured in the disc annular opening (or in the disc peripheral opening) at the first end of the lead line, and secured at the second end (once the disc is buried in the sand) to the boat.

A plurality of ridges or slurry paddles, protruding from the disc, is formed on the bottom side of the disc. A plurality of recessed portions, or slurry chambers, is formed between the ridges for collecting sand slurry therein. The slurry paddles are designed to cut through the sand as the disc is rotatably positioned beneath the sand. More preferably, the slurry paddles or ridges may be formed in a geometric pattern, such as a cross, thereby resulting in a plurality of symmetric slurry chambers formed between the slurry paddles. In the embodiment containing the cross-shaped ridges, four quadrants are formed as slurry chambers on the bottom side of the disc. As also shown, each of four ridges forming the cross-shaped pattern extend radially outward from the center of the disc to the periphery or outer circumference of the disc.

As shown in the figures, another embodiment includes cross-shaped ridges and an inner ridge formed as a concentric circle formed within the outer circumference of the disc. If desired, the outer circumference of the disc may formed as a broken set of ridges wherein gaps in the outer circumference ridge are positioned to permit sand to exit from the inner slurry chambers as the disc is torqued into position beneath the sand. Alternatively, the outer circumference may not at all contain a ridge and may instead constitute a plurality of "gates" corresponding to each slurry chamber, wherein excess sand collecting within each slurry chamber may migrate radially outwardly as the disc is rotatably positioned beneath the sand. The area between the inner circle and the outer circumference constitute a first set of slurry chambers. A second area, between the inner circle paddles and the exact middle of the disc having an axis running orthogonal to either side of the disc, may constitute a second set of slurry chambers.

Four paddles may also be formed on the periphery of the disc at the 12:00, 3:00, 6:00, and 9:00 positions, thereby providing an additional means to cut through the sand as the disc is rotated.

As also shown in the figures, an interlocking recessed portion designed or configured to mate with an application tool may be formed in the middle portion of the upper side of the disc. A hollow tube forms the body of an applicator or application tool, wherein the applicator has a first end and a second end. Alternatively, a solid tube may form the applicator body. A pattern formed on the first end is designed or configured to fit within the interlocking recessed portion on the upper side of the disc, in a complementary or "lock and key" type of fit. As the applicator first end is fit within the interlocking recessed portion on the upper side of the disc, the applicator can then be used to torque the disc into the sand in a rotary motion. When the lead line is connected to the center of the disc, the lead line may extend through the hollow tube out the second end of the applicator as the applicator is being used to insert the disc within the sand. A handle is located on the second end of the applicator body and enables the operator to turn the applicator hollow tube as it fits within the disc, thereby imparting a rotary motion to the disc. Once the disc is secured within the sand, the hollow tube may be pulled up and out of the disc, thereby leaving the lead line attached to the disc that is now buried in the sand. The lead line second end may then be secured to the boat as desired.

In operation, as the disc is rotated by torqueing the applicator handle, the slurry paddles displace sand that is then deposited within the slurry chambers, from which sand may also migrate from the outer gates as explained above. It is believed that at the same time, a vacuum is also created beneath the disc within the slurry chambers, thereby contributing to the "locked" position of the disc beneath the sand.

In further accordance with the invention, one or more discs with load lines may be used to secure the boat or watercraft. The load lines may be calibrated to resistances of thirty, fifty, seventy-five, one hundred, or any other number of pounds. The discs may be sized to the desired average diameter such as the four-inch or six-inch diameter embodiments shown in the figures.

The disc may be removed by reinserting the hollow tube over the lead line and then re-engaging the interlocking recessed portion and providing a reverse turn to the disc. Alternatively, the lead line may be pulled to displace the sand about the disc and thereby break the "vacuum" that holds the disc in place beneath the sand.

The same small amount of water is recycled again and again within the "slurry envelope" created below the sand surface. Only when the applicator tube is removed is there a pathway for this water to escape. The specific dimensions of the slurry teeth varies from size to size. The cutting face of the teeth should be as narrow as possible (without risk of breaking) to provide the best results. The fin height can be between ¼" and ¾" and preferably about ½". Any taller is not necessary and any shorter cramps the slurry chamber space and effects insertion. Generally, devices with a diameter of less than 3" start becoming more difficult to insert due to less turbulent water effects in the slurry chamber because of the shorter fin sweeps.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A watercraft anchor system comprising:

a disc shaped member having a top surface defining a locking surface, a bottom circular surface, and a periphery surface disposed between the top and bottom surfaces, the disc shaped member having a diameter greater than a height;

a plurality of paddles radially extending from the periphery surface; and a plurality of flanges disposed on the bottom surface.

2. The watercraft anchor according to claim 1 wherein the flanges are angularly aligned with the paddles.

3. The watercraft anchor according to claim 1, wherein the locking surface is a plurality of arcuate cavities.

4. The watercraft anchor according to claim 1, wherein the plurality of flanges include four flanges.

5. The watercraft anchor according to claim 4, comprising four paddles disposed on the periphery surface.

6. The watercraft anchor according to claim 5, wherein the four paddles are aligned with the plurality of flanges.

7. The watercraft anchor according to, claim 5 further comprising a handle member coupled to the locking surface.

8. The watercraft anchor system of claim 1, further comprising an elastic load line for applying a constant source of tension to the disc shaped member after the disc shaped member is inserted under sand.

9. The watercraft anchor system of claim 1, wherein the paddles reduced friction during insertion and the paddles are offset from the periphery surface to create slurry gaps allowing the passage of slurry material during insertion and removal.

10. The watercraft anchor system of claim 1, in combination with an insertion tool, the insertion tool having a plurality of recesses for engaging the disc shaped member.

11. The watercraft anchor system of claim 1, wherein the plurality of paddles includes four paddles.

12. The watercraft anchor system of claim 1, wherein each paddle includes a convexly curved radially outer surface.

13. A method of anchoring a boat into sand under water comprising:

coupling a disc shaped anchor member having a top surface defining a locking surface, a bottom circular surface, and a periphery surface disposed between the top and bottom surfaces, a plurality of paddles radially extending from the periphery surface, and a plurality of flanges disposed on the bottom surface to an insertion tool;

positioning the anchor member onto a sand surface;

agitating the insertion tool to apply a rotary and axial force onto the anchor member through the insertion tool to create a slurry material of water and sand and to displace the slurry material to the top surface of the anchor member into the sand a predetermined depth; and extracting the insertion tool from the sand while leaving the anchor member completely under the sand.

14. The method of claim 13, further comprising applying a constant tension to the disc shaped member with an elastic load line.

15. The method of claim 13, further comprising allowing the passage of slurry material through gaps between adjacent paddles during insertion.

16. The method of claim 13, agitating available water and loose sand with the flanges to create the slurry material.

17. A watercraft anchor system comprising:

a disc shaped anchor having a top surface, a bottom surface, and a periphery surface disposed between the top and bottom surfaces, the disc shaped anchor having a diameter greater than a height;

at least three paddles radially extending from the periphery surface; and a plurality of flanges disposed on the bottom surface.

18. The watercraft anchor system of claim 17, further comprising an elastic load line for applying a constant source of tension to the disc shaped member after the disc shaped member is inserted under sand.

19. The watercraft anchor system of claim 17, wherein the paddles reduced friction during insertion and the paddles are offset from the periphery surface to create slurry gaps allowing passage of slurry material during insertion and removal.

20. The watercraft anchor system of claim 17, wherein each paddle includes a convexly curved radially outer surface.

* * * * *